US007607766B2

(12) United States Patent
Steiner

(10) Patent No.: US 7,607,766 B2
(45) Date of Patent: Oct. 27, 2009

(54) METHOD AND PRINT HEAD FOR FLOW CONDITIONING A FLUID

(75) Inventor: Thomas W. Steiner, Burnaby (CA)

(73) Assignee: Kodak Graphic Communications Canada Company, Burnaby (CA)

( * ) Notice: Subject to any disclaimer, the term of this patent is extended or adjusted under 35 U.S.C. 154(b) by 279 days.

(21) Appl. No.: 11/568,229

(22) PCT Filed: May 4, 2005

(86) PCT No.: PCT/CA2005/000659

§ 371 (c)(1),
(2), (4) Date: Oct. 24, 2006

(87) PCT Pub. No.: WO2005/105453

PCT Pub. Date: Nov. 10, 2005

(65) Prior Publication Data

US 2007/0229608 A1 Oct. 4, 2007

Related U.S. Application Data

(60) Provisional application No. 60/567,442, filed on May 4, 2004.

(51) Int. Cl.
*B41J 2/02* (2006.01)

(52) U.S. Cl. ..... 347/73

(58) Field of Classification Search ..... 347/73, 347/74, 75, 68, 69, 70
See application file for complete search history.

(56) References Cited

U.S. PATENT DOCUMENTS

| | | | | |
|---|---|---|---|---|
| 4,184,925 | A | 1/1980 | Kenworthy | |
| 4,229,265 | A | 10/1980 | Kenworthy | |
| 4,638,327 | A | 1/1987 | Sutera et al. | |
| 5,912,685 | A | 6/1999 | Raman | |
| 7,033,003 | B2 * | 4/2006 | Martin et al. | 347/75 |

FOREIGN PATENT DOCUMENTS

| | | |
|---|---|---|
| EP | 0 287 372 | 7/1991 |
| EP | 1 219 424 | 2/2005 |

* cited by examiner

*Primary Examiner*—K. Feggins
(74) *Attorney, Agent, or Firm*—Nelson Adrian Blish

(57) ABSTRACT

A continuous inkjet print head jets a plurality of fluid streams from an array of multiple nozzle channels. The print head includes a flow conditioning means that establishes fully developed flow in one or more regions of the print head such that substantially equal flow conditions are created at each of the inlets of the multiple nozzle channels. The substantially equal flow conditions reduce nozzle-to-nozzle variations with respect to the required trajectories of the jetted fluids to improve jet pointing and thus lead to better print quality.

42 Claims, 5 Drawing Sheets

METHOD AND PRINT HEAD FOR FLOW CONDITIONING A FLUID

REFERENCE TO RELATED APPLICATION

This application claims priority from U.S. Provisional Application Ser. No. 60/567,442, entitled "Method for Flow Conditioning in an Inkjet Printing Head", filed May 4, 2004.

TECHNICAL FIELD

The invention pertains to inkjetting fluids and, in particular, to the conditioning of fluid prior to being jetted by a nozzle.

BACKGROUND

The use of inkjet printers for printing information on a recording media is well established. Printers employed for this purpose may be grouped into those that emit a continuous stream of fluid droplets, and those that emit droplets only when corresponding information is to be printed. The former group is generally known as continuous inkjet printers and the latter as drop-on-demand inkjet printers. The general principles of operation of both of these groups of printers are well recorded. Drop-on-demand inkjet printers have become the predominant type of printer for use in home computing systems, while continuous inkjet printers find major application in industrial and professional environments.

Continuous inkjet printers typically have a print head that incorporates a supply system for ink fluid and a nozzle plate with one or more ink nozzles fed by the ink fluid supply. A gutter assembly is positioned downstream from the nozzle plate in the flight path of ink droplets to be guttered. The gutter assembly catches ink droplets that are not needed for printing on the recording medium.

In order to create the ink droplets, a drop generator is associated with the print head. The drop generator influences the fluid stream within and just beyond the print head by a variety of mechanisms discussed in the art. This is done at a frequency that forces thread-like streams of ink, which are initially jetted from the nozzles, to be broken up into a series of ink droplets at a point within a vicinity of the nozzle plate.

Means for selecting printing drops from non-printing drops in the continuous stream of ink drops have been well described in the art. One commonly used practice is that of electrostatically charging and electrostatically deflecting selected drops. A charge electrode is positioned along the flight path of the ink droplets. The function of the charge electrode is to selectively charge the ink droplets as the droplets break off from the jet. One or more deflection plates positioned downstream from the charge electrodes create an electric field which deflects a charged ink droplets either into the gutter or onto the recording media. In some systems, the droplets to be guttered are charged and hence deflected into the gutter assembly and those intended to be printed on the media are not charged and hence are not deflected. In other systems, the arrangement is reversed, and the uncharged droplets are guttered, while the charged droplets are printed. Continuous inkjet printers employing these electrostatic droplet separation means are referred to as electrostatic continuous inkjet print heads.

In high quality inkjet printing, it is desirable to provide small and uniform ink droplets which may be accurately printed on the media. Accordingly, it is desirable to provide a high degree of accuracy with respect to the size and placement of the individual nozzle channels in an array of nozzle channels on the nozzle channel plate. Further, it is desirable that the pressurized fluid delivered through these nozzle channels be provided similar flow conditions from nozzle to nozzle.

An array of inkjet nozzle channels is typically fed by ink from a fluid reservoir. The construction of these reservoirs can lead to dissimilar flow conditions at the inlets of various individual nozzle channels within the array. Dissimilar flow conditions between the inlets to the nozzle channels in the array, can arise from a number of factors. Dissimilar ink flow into the inlets can be caused by differing flow components in the direction perpendicular to flow into the nozzle channels, called cross flow, or parallel to flow in the nozzle channels, called axial flow. Dissimilar flow conditions between nozzle channel inlets can give rise to dissimilar flow in the nozzle channels themselves.

Turbulence arising from ink flow in the reservoir inlet and outlet structures, can also cause variations in fluid flow into the nozzle channel inlets. In the operation of inkjet print heads, cross-flow may arise when ink travels from the reservoir inlet to each of the nozzle channel inlets of the array and/or to the reservoir outlet. The reservoir outlet may be left open during print head operation to maintain a flow of ink which aids in the removal of undesirable particulates that can lead to sedimentation and nozzle clogging. With or without an open reservoir outlet, reservoir inlet geometry and nozzle channel geometry can lead to differential ink flow and turbulence at one or more nozzle channel inlets. Dissimilar flow conditions are likely to occur in inkjet print heads in which nozzle channels located at the ends of an array are subjected to different flow rates or turbulence levels than the nozzle channels located within the central regions of the array.

The ink jetted from any given nozzle channel may retain a memory of the respective ink flow conditions that existed at the inlet of the nozzle channel. The memory of the ink flow conditions results from momentum components and random pressure variations in the fluid and gives rise to some persistence of the initial flow conditions over some distance, depending on the nature of the flow. Given this memory, dissimilar ink flow conditions as between nozzle channel inlets may contribute to a deleterious printing effect referred to as "non-uniform jet pointing". Non-uniform jet pointing may result in nozzle-to-nozzle variations in the desired trajectories of the jetted fluid streams and their subsequently formed droplets. Other factors including poorly controlled manufacture of the nozzle channels and particulate contamination can contribute to non-uniform jet pointing. Variation in the flow conditions at the nozzle channel inlets may additionally create adverse effects such as jet velocity variability. Variability in jet velocity may lead to variation in the size of the resulting droplets. These effects may lead to additional inaccuracies in droplet placement on the media, and consequently poor printing quality.

This phenomenon is further illustrated by the prior art inkjet print head 10 shown in FIG. 1. Print head 10 includes a fluid reservoir 20 and a plurality of nozzle channels 30. Dissimilar ink flow conditions exist among the various nozzle channel inlets 32. These unequal ink flow conditions may be caused by turbulence or variation in cross-flow or axial flow as ink enters reservoir inlet 40 and travels within reservoir 20 to the various channel inlets 32. The ink can optionally exit reservoir 20 via reservoir outlet 50 and this may contribute to the dissimilar flow conditions that exist between channel inlets 32. The ink in each channel 32 retains a memory of the particular non-uniform flow conditions that exist at its respective channel inlet 32. Channel inlet flow areas with a great deal of non-uniformity will cause greater amounts of jetted stream instability or trajectory variance as shown by jets 60.

Jets 60 may be located at the edges of the array. Channel inlet flow areas with a lesser amount of non-uniformity will create a reduced amount of jetted stream instability or trajectory variance as shown by jets 70. Jets 70 may be located in the interior of the array. This variance in jetted stream trajectory or stability between nozzle channels is referred to in the art as non-uniform jet pointing.

In U.S. Pat. No. 5,912,685, Raman discloses a drop-on-demand (DOD) inkjet head in which an "island" of material is located near the entrance of an ink-firing chamber. This island creates multiple ink feed channels for introducing ink to an ink-firing chamber. The prevalent unequal ink flow conditions that exist in the Raman print head are magnified by changing the aspect ratio of the "island" to induce significantly different fluid resistances in each of the multiple ink feed channels. The higher resistance channels help to reduce unwanted cross-talk effects among the nozzles that are adjacent a particular nozzle that is activated.

In European Patent Application EP 1,219,424, Anagnostopoulos et al. describe a print head that also uses "islands" or blocking structures. These blocking structures however are used to impart additional lateral flow components to ink entering an inkjet nozzle. In the Anagnostopoulos et al. device, asymmetric heating is employed to purposely deflect the jetted streams. The asymmetric heating alone may not provide the degree of deflection that is required. The lateral flow components induced by the blocking structures are a factor in increasing the amount of desired stream deflection. Anagnostopoulos et al. disclose the use of dissimilar ink flow conditions to purposely deviate the trajectory of a jetted stream. Thus, the adverse impact that unequal flow conditions have on nozzle-to-nozzle jet pointing is evident. Additionally, in U.S. Pat. No. 6,491,385, Anagnostopoulos et al. disclose a multi-nozzle print head employing asymmetric heating to deflect the jetted streams and the use of ribs or bridges to create ink channels around each of the nozzles. The ribs are used to strengthen the print head and to reduce pressure variations in the ink channels due to low frequency pressure waves.

Small, closely spaced nozzle channels, with highly consistent geometry and placement can be constructed using micro-machining technologies such as those used in the semiconductor industry. Typically, nozzle channel plates produced with these techniques are made from materials such as silicon and other materials commonly employed in semiconductor manufacture. Further, multi-layer combinations of materials can be employed with different functional properties including electrical conductivity.

Micro-machining technologies include etching through the nozzle channel plate substrate to produce the nozzle channels. These etching techniques can include one of, or a combination of wet chemical, inert plasma or chemically reactive plasma etching processes. The materials employed to produce the nozzle channel plates can have particular etching properties that make them suitable for a particular etching process or that can control the etching rate and the etch profile. The micro-machining methods employed to produce the nozzle channel plates can also be used to produce other structures in the print head. These other structures may include ink feed channels and ink reservoirs. Thus, an array of nozzle channels may be formed by etching through the surface of a substrate into a large recess or reservoir which itself is formed by etching from the other side of the substrate.

Micro-machining techniques for the construction of various inkjet head structures have their limitations. To minimize the deleterious effects of substantially unequal flow conditions among nozzle channel inlets, it is desirable to form nozzle channels having uniform diameter and sufficient length to achieve substantially equal flow conditions across the nozzle channels. Such nozzle channels cannot always be readily manufactured by micro-machining techniques. Technologies such as Deep Reactive Ion Etching (DRIE) can be used to etch silicon to form nozzle channels. The difficulty encountered however, is that in order to achieve similar flow conditions among the nozzle channels, typical channel lengths of several hundred microns are required. State of the art inkjet devices typically require small nozzle channel diameters in the order of 10 to 20 microns. Etch processes such as DRIE are incapable of etching such high aspect ratio channels in a timely manner and with consistent uniformity. Additionally, the long channel lengths which help produce the desired flow conditions in such small nozzle channels lead to significant pressure losses over the channel length. It is desirable to minimize the impact of these pressure losses by operating the ink delivery system at relatively high operating pressures in order to achieve desirable jetting velocities.

There is a general desire for flow conditioning methods and means to improve inkjet print heads by reducing dissimilarities in fluid flow conditions across the nozzle channels in an array to minimize non-uniform jet pointing. There is a further desire to provide for an inkjet print head that can be more readily manufactured with the appropriate flow conditioning means.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

A continuous inkjet print head jets a plurality of fluid streams from an array of nozzle channels. The fluid streams are subsequently converted into streams of droplets that travel along a particular trajectory or are deflected to travel along some other trajectory to either print or not print. Flow conditioning methods and means are employed to establish substantially fully developed flow within one or more regions of the fluid in the print head to establish substantially equal flow conditions at each of the inlets of the nozzle channels. Maintaining substantially similar flow conditions at each of the nozzle channel inlets minimizes jet point errors, thus improving print quality.

A first aspect of the invention provides a method for jetting at least one continuous stream of fluid from at least one corresponding nozzle channel of a multi-channel print head. The method includes establishing substantially fully developed flow in at least one first region of a fluid in the print-head and jetting the fluid in at least a portion of the first region from the at least one nozzle channel. The at least one nozzle channel may comprise a plurality of nozzle channels, each of which has an inlet. The method may comprise establishing substantially equal flow conditions at each of the inlets. The at least one nozzle channel may comprise an inlet and the first region may be proximate to the inlet. The method may also involve establishing substantially fully developed flow in a plurality of first regions of the fluid in the print head and the plurality of first regions may have substantially equal flow conditions.

The substantially fully developed flow may be established by a first flow conditioning means. The first flow conditioning means may establish substantially fully developed laminar flow in the first region. The first flow conditioning means may comprise at least one conduit with an axial length equal to or greater than an entrance length associated with the at least one conduit. The method may involve establishing substantially fully developed flow within the at least one conduit. The axial length of the at least one conduit may be sized to establish substantially fully developed laminar flow within the at least one conduit. The method may involve establishing a first volume flow rate of the fluid through the at least one conduit and a second volume flow rate of the fluid through the at least one nozzle channel, wherein the first and second volume flow rates are equal.

The method may include establishing a second flow in at least one second region of the fluid in the print head and jetting the fluid in at least a portion of the second region from at least one additional nozzle channel. The at least one additional nozzle channel may comprise a plurality of additional nozzle channels, each of which comprises an additional inlet. The method may involve establishing substantially equal flow conditions at each of the additional inlets. The at least one additional nozzle channel may comprise an inlet and the second region may be proximate to the inlet. The method may involve establishing second flows in a plurality of second regions of the fluid in the print head, wherein the plurality of second regions have substantially equal flow conditions. The second flow may comprise substantially fully developed flow. The second flow may be established to be substantially fully developed by a second conditioning means. The second flow may comprise substantially fully developed laminar flow.

Another aspect of the invention provides a multi-channel print head for jetting at least one continuous stream of fluid. The print head comprises at least one first flow conditioning means operable for establishing substantially fully developed flow in at least one first region of a fluid in the print head and at least one nozzle channel in fluid communication with the at least one first region. The at least one nozzle channel is operable for jetting the at least one continuous stream from at least a portion of the at least one first region.

The at least one nozzle channel may comprise a plurality of nozzle channels, each having an inlet. The at least one first flow conditioning means may be operable for establishing substantially equal flow conditions at each of the inlets. The at least one nozzle channel may comprise an inlet and the first region may be proximate to the inlet. The at least one first region may comprise a plurality of first regions and the at least one first flow conditioning means may be operable for establishing substantially equal flow conditions in the plurality of first regions.

The print head may comprise a fluid accumulator positioned between the at least one first flow conditioning means and the at least one nozzle channel. The at least one first flow conditioning means may be operable for establishing substantially fully developed laminar flow in the at least one first region.

The at least one first flow conditioning means may comprise a least one backside tunnel, the at least one backside tunnel being operable for establishing substantially fully developed flow in the at least one first region. The at least one backside tunnel may comprise an axial length equal to or greater than an entrance length associated with the at least one backside tunnel. The at least one backside tunnel may be in direct fluid communication with the at least one nozzle channel. The at least one nozzle channel and/or the at least one backside tunnel may be fabricated by micro-machining. The at least one backside tunnel and the at least one nozzle channel may be fabricated in a monolithic component.

The at least one first flow conditioning means may comprise a flow conditioning plate having at least one flow conditioning bore therethrough, the flow conditioning bore operable for establishing the substantially fully developed flow in the at least one first region. The at least one flow conditioning bore may comprise an axial length that is equal to or greater than an entrance length associated with the at least one flow conditioning bore. The at least one flow conditioning bore may comprise a plurality of flow conditioning bores and a number of the flow conditioning bores may be greater than a number of the nozzle channels. The at least one flow conditioning bore may comprise a first cross-sectional area, the at least one nozzle channel may comprise a second cross-sectional area and the first cross-sectional area may be smaller than the second cross-sectional area. The flow conditioning plate may be a filter means. The print head may comprise a fluid accumulator positioned between the flow conditioning plate and the at least one nozzle channel. The flow conditioning plate may be fabricated by micro-machining.

The at least one nozzle channel may be the flow conditioning means. The at least one nozzle channel may comprise an axial length equal to or greater than an entrance length associated with the at least one nozzle channel.

The print head may comprise at least one second conditioning means operable for establishing a second flow in at least one second region of the fluid in the print head and at least one additional nozzle channel of the multi-channel print head in fluid communication with the at least one second region. The at least one additional nozzle channel may be operable for jetting at least one corresponding additional continuous stream of the fluid from at least a portion of the at least one second region. The at least one additional nozzle channel may comprise a plurality of additional nozzle channels, each additional nozzle channel comprising an additional inlet. The at least one second conditioning means may be operable for establishing substantially equal flow conditions at each of the additional inlets. The at least one additional nozzle channel may comprise an additional inlet and the at least a second region may be proximate to the additional inlet. The at least one second region may comprise a plurality of second regions and the at least one second conditioning means may be operable for establishing substantially equal flow conditions in the plurality of second regions. The flow conditions in the at least one first region may be different than the flow conditions in the at least one second region. The second flow may comprise substantially fully developed flow. At least one of the first flow conditioning means and the second conditioning means may comprise a back side tunnel and/or a flow conditioning plate.

In addition to the exemplary aspects and embodiments described above, further aspects and embodiments will become apparent by reference to the drawings and by study of the following detailed descriptions.

BRIEF DESCRIPTION OF DRAWINGS

In drawings which illustrate non-limiting embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
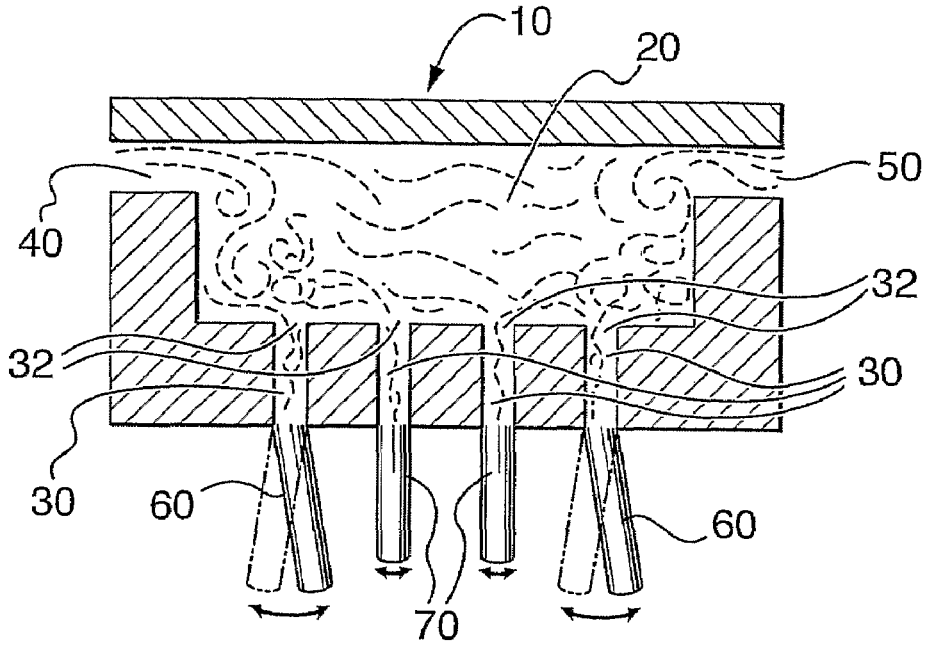
FIG. 1 PRIOR ART
FIG. 1 is a cross-sectional view of a portion of a prior art inkjet print head.

FIG. 1 shows a portion of a prior art continuous inkjet print head that includes an array of nozzle channels. Dissimilar flow conditions are likely to occur as between nozzle channels in this prior art print head, since the nozzle channels located at the ends of an array are subjected to different flow rates or turbulence levels than the nozzle channels located within the central regions of the array. The fluid jetted from any given nozzle channel will likely retain a memory of the respective fluid flow conditions that existed at that particular nozzle channel's inlet unless certain conditions on the structure are met. Without these structural conditions and given this memory, dissimilar fluid flow conditions at the various nozzle channel inlets tend to contribute to a deleterious printing effect referred to as "non-uniform jet pointing". Non-uniform jet pointing results in at least some nozzle-to-nozzle variations in the desired trajectories of the jetted fluids and their subsequently formed droplets. Additional adverse effects due to variation in these flow conditions may also include jet velocity variability. Jet velocity variability leads to variation in the size of the droplets subsequently formed from the jetted stream. These effects lead to additional inaccuracies in droplet placement on the media, and consequently, poor printing quality.

Figure 2:
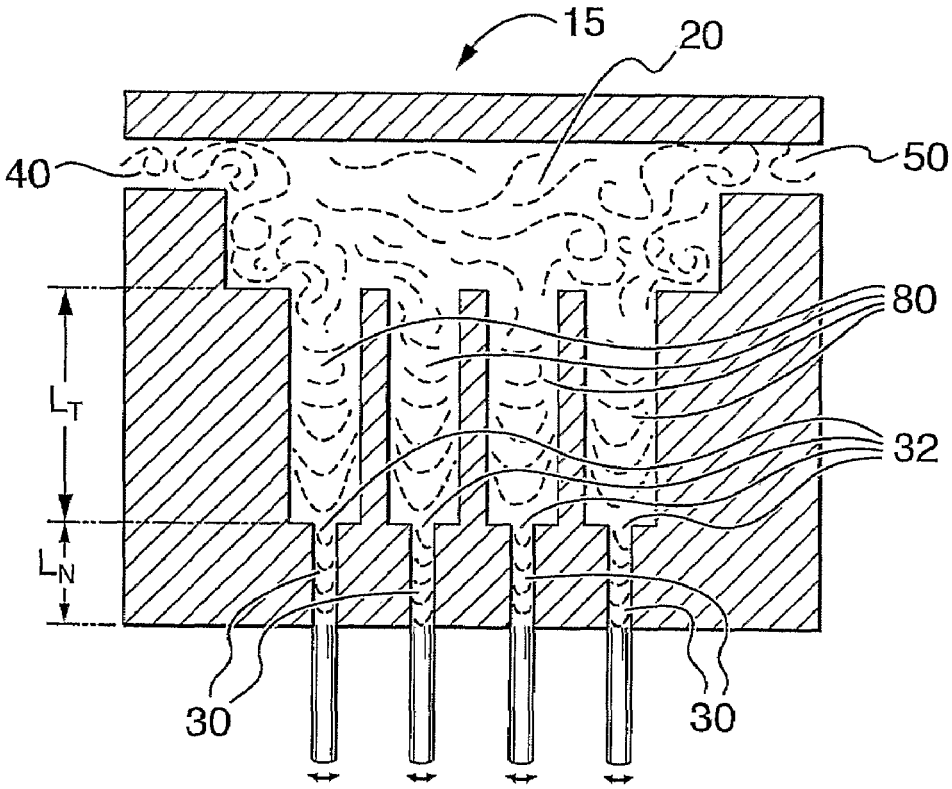
FIG. 2 is a cross-sectional view of a portion of an inkjet print head according to a particular embodiment of the invention in which backside tunnels are used to produce substantially equal flow conditions across the inlets of a number of inkjet nozzle channels.

FIG. 2 shows a continuous inkjet print head 15 as per a particular embodiment of the invention. Inkjet print head 15 comprises fluid reservoir 20 and a plurality of channels 30. For clarity, inkjet print head 15 is shown in FIG. 2 as having four channels. In general, inkjet heads according to any of the embodiments of the invention disclosed herein may have any suitable number of channels. Inkjet heads according to the invention are specifically not limited to the number of nozzle channels shown in the embodiments illustrated herein.

Nozzle channels 30 are used to produce continuous jets of fluid. Non-uniform flow conditions can be caused by turbulence or variation in cross-flow or axial flow as fluid enters reservoir inlet 40 and travels within reservoir 20. Print head 15 also comprises a flow conditioning means. As used in this description and the accompanying claims, a flow conditioning means is a means for establishing fully developed flow in one or more regions of a fluid in the print head. At least a portion of these one or more regions of the fluid may be subsequently jetted by at least one of the nozzle channels of the print head. Since the flow conditioning means establishes substantially fully developed flow in the one or more regions, substantially equal flow conditions are created at the inlets of a plurality of nozzle channels during the jetting of fluid from these one or more regions. It is understood that if the flow conditions are substantially equal at the inlets of the plurality of nozzle channels, then the flow conditions will be substantially equal within the nozzle channels, if the nozzles channels themselves are similar to one another. The one or more regions of the fluid in the print head may be in proximate relationship to one or more of the nozzle channel inlets.

In the FIG. 2 embodiment, the flow conditioning means includes a plurality of conduits referred to as backside tunnels 80. Fully developed flow is established in the regions of the fluid within the backside tunnels 80. In the FIG. 2 embodiment, each backside tunnel 80 corresponds to an associated nozzle channel 30, although this one to one correspondence is not necessary. Both backside tunnels 80 and nozzle channels 30 may be formed by micro-machining techniques typically used in the semiconductor industry. These micro-machining techniques may include, but are not limited to, wet chemical, inert plasma or chemically reactive plasma etching.

Backside tunnels 80 are etched with a conduit open to accept fluid from reservoir 20. The length of backside tunnels 80 is determined by the desire to have fully developed flow created therein. As used in this description and the accompanying claims, fully developed flow is defined by the situation where a bounded flow in a conduit has the characteristics of an unchanging velocity profile within the conduit, where the wall shear is at least approximately constant and the pressure drops at least approximately linearly with distance along the axial length of the conduit. Fully developed flow may be established in both laminar and turbulent flows. Fully developed turbulent flow has a "blunter" velocity profile than fully developed laminar flow. Once the flow is fully developed in regions of the fluid within backside tunnels 80, all memory of flow conditions at the inlets of backside tunnels 80 tends to vanish regardless of whether such flow conditions resulted from differential flow across or into the tunnel inlets, or from turbulent flow at the tunnel inlets.

Nozzle channels 30 may be formed near or beyond the point in the backside tunnel 80 at which fully developed flow occurs. The flow transition from a backside tunnel 80 into its corresponding nozzle channel 30 may cause the fluid to change from its fully developed flow condition. However, this is not considered to be detrimental, since the flow conditions that result within each of the nozzle channels 30 will be substantially similar to each other and thus, substantially uniform jet pointing is likely to occur. Therefore, a flow conditioning means, such as backside tunnels 80, establishes fully developed flow conditions within one or more regions of the fluid in print head reservoir 20 to establish substantially equal flow conditions at each of the nozzle channels inlets 32. The one or more regions of the fluid are preferably proximate to the inlets 32 of nozzle channels 30. Nozzle channels 30 may be concentric with their corresponding backside tunnels 80 (although this is not necessary) and may have a smaller diameter (or cross-sectional area) than backside tunnels 80. Backside tunnels 80 need not be cylindrical in cross section, but can take any arbitrary shape that permits the formation of fully developed flow. This characteristic can be coupled with the structural requirements that are desirable for efficient and uniform manufacturing, such as those requirements of micro-machining etching techniques.

Embodiments of the flow conditioning means may be designed to establish fully developed turbulent flow. Fully developed laminar flow is preferred, however, since laminar flow will produce less noise in the fluid motion at the nozzle channel inlets 32, thus further minimizing jet point errors.

A conduit of a given diameter requires a minimum axial length in order to establish fully developed flow within a fluid flowing through the conduit. This minimum axial length is referred to as the entrance length. The following relationships may be used to define the geometric characteristics of a conduit (such as a backside tunnel 80) required to establish fully developed flow in a Newtonian fluid within the conduit. The entrance length required for the development of fully developed flow within a cylindrical backside tunnel is determined by the physical parameters defining the Reynolds number, Re, of the fluid system which include the fluid density, ρ; the average flow velocity in the tunnel, $V_t$; the diameter of the back side tunnel, $D_t$; and the fluid viscosity, μ. Specifically:

$$Re=\rho V_t D_t/\mu.$$

The entrance length or minimum backside tunnel axial length required to establish fully developed laminar flow may be determined by the relationship:

$$L_T=E_L D_t;$$

where $L_T$ is the entrance length required to produce fully developed laminar flow, and; $E_L$ is the laminar flow entrance length number for a particular conduit shape (e.g. for a cylindrical conduit, $E_L$ is approximately $E_L$=0.06 Re).

In the case of fully developed turbulent flow in a cylindrical conduit, the turbulent flow entrance length number would be derived from the relationship: $E_t=4.4\ Re^{1/6}$. The entrance length or minimum backside tunnel axial length required to establish fully developed turbulent flow may then be determined by the relationship $L_T=E_t D_t$.

Like the Reynolds number, the entrance length number is a dimensionless number. The entrance length number may be used to determine in part, the minimum length of a channel with a particular geometry required to create fully developed flow for the particular conditions of the fluid system.

The diameter, $D_t$ of cylindrical backside tunnel 80, may be chosen to provide an aspect ratio, $L_T/D_t$ which may be readily etched using micro-machining techniques. It is to be noted that $E_L$ is a function of both $D_t$ and $V_t$. $L_T$ is the minimum axial length required for the formation of a backside tunnel that can establish fully developed flow within the fluid regions therein. Backside tunnels 80 may be fabricated in a separate substrate component with a thickness equal or greater than length $L_T$. Further, both the backside tunnels 80, and the nozzle channels 30 may be advantageously fabricated in a single monolithic component. The present invention does not preclude combining other parts of the inkjet head, such as parts of reservoir 20, during the micro-machining of the tunnels or channels. Combining as many of the elements of print head 15 as possible into a single monolithic component can simplify the manufacturing and assembly processes that are required.

When a flow conditioning means is employed, the length of the nozzle channels 30, $L_N$, need not be sufficiently long to induce fully developed flow within the nozzle channels 30 themselves. Although the fluid flow may not be fully developed within each of the nozzle channels 30, the fluid in each of the nozzle channels 30 will have flow conditions that are substantially similar. This occurs because the flow in each of the nozzle channels 30 is conditioned by backside tunnels 80 prior to entrance into nozzle channel inlets 32. Thus, any memory of any turbulent or non-uniform cross-flow or axial flow conditions from the fluid supply is substantially eliminated. Therefore, nozzle channels 30 may be fabricated with relatively short lengths and may have length to diameter aspect ratios that can be manufactured more readily, especially when the diameters of nozzle channels 30 are less than 20 microns. Preferably, backside tunnels 80 are all of the same size and shape to ensure that the regions of the fluid therein have substantially similar flow conditions. Since backside tunnels 80 are in direct fluid communication with their corresponding nozzle channels 30, these regions of fluid are proximate to nozzle channel inlets 32 and the flow conditions at inlets 32 will also be substantially similar.

In alternative embodiments, the flow conditioning means may be incorporated within the nozzle channels themselves, especially when larger diameter channels are desired. In such embodiments, the length of the nozzles is sufficiently long to allow fully developed flow to be established within the nozzle channels themselves.

Figure 3:
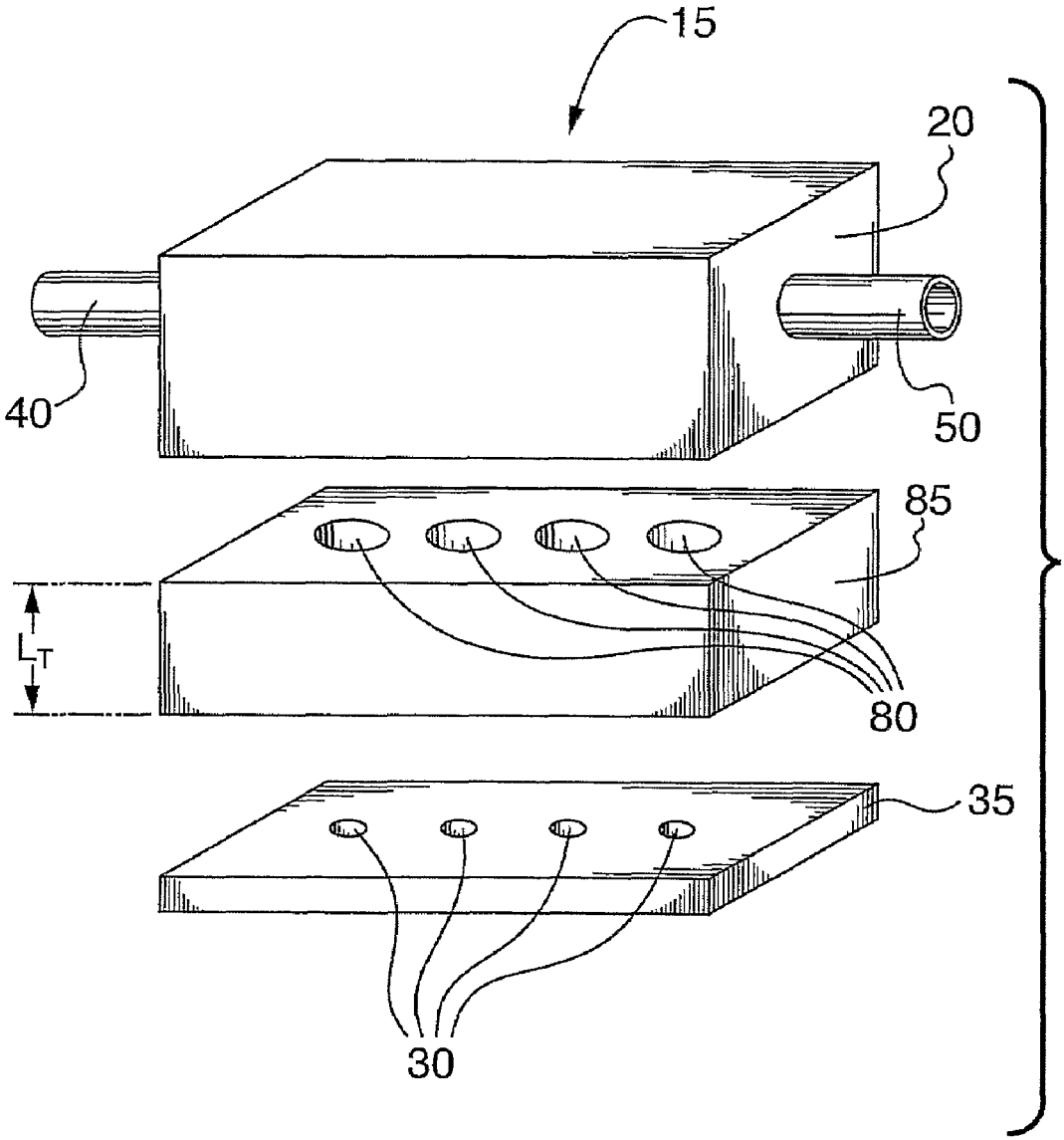
FIG. 3 is an exploded view of a portion of an inkjet print head according to an embodiment of the invention that comprises a separate backside tunnel layer and a separate nozzle channel layer.

FIG. 3 shows an exploded view of a print head 15 according to an embodiment of the invention in which inkjet print head 15 includes a fluid reservoir 20 through which a supply of pressurized fluid flows. Reservoir 20 interfaces with tunnel layer 85 which comprises a separate plate of thickness greater than or equal to $L_T$ as previously described. Tunnel layer 85 includes backside tunnels 80. Below tunnel layer 85, nozzle plate 35 is positioned with nozzle channels 30 aligned with backside tunnels 80. When print head 15 is assembled, fluid flows through reservoir inlet 40 into reservoir 20. Variations in the flow of fluid may occur at the top surface of the openings in tunnel plate 85. However, by the time the fluid flows through the tunnel layer 85, the flow is fully developed in backside tunnels 80 and the fluid enters nozzle plate 35 without the variation in flow conditions that may be present in reservoir 20.

In the FIG. 3 embodiment, the various parts of inkjet head 15 are separately manufactured components that are subsequently assembled together. Bonding is typically the preferred method of assembly. As previously noted, it is beneficial to construct as many of the print head elements into a monolithic component as is feasible.

Figure 4:
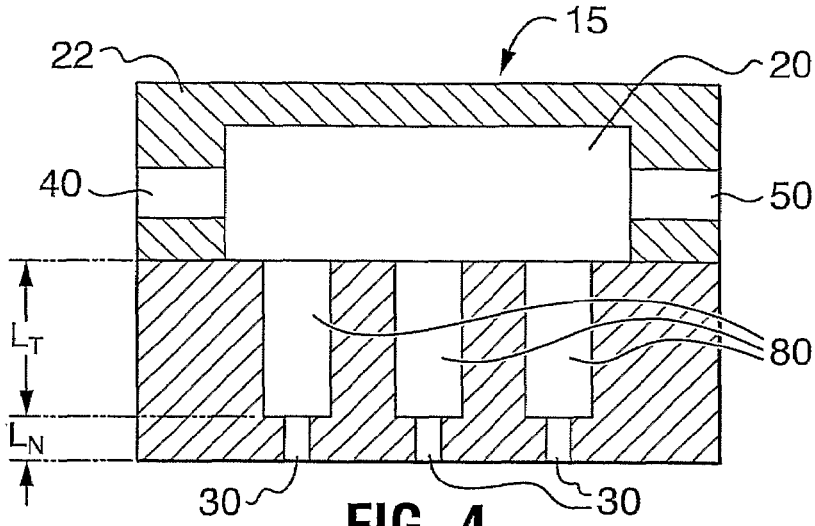
FIG. 4 is a cross-sectional view of a portion of an inkjet print head according to an embodiment of the invention in which backside tunnels and nozzle channels are combined in a monolithic component.

FIG. 4 shows a cross-sectional view of a portion of a print head in accordance with another embodiment of the invention. In the FIG. 4 embodiment, backside tunnels 80 and nozzle channels 30 are fabricated from the same substrate. The substrate may be a silicon wafer, for example. In the FIG. 4 embodiment, the combined etched backside tunnel and nozzle channel arrays are fabricated from a substrate with a minimum thickness equaling $L_T+L_N$ (as previously described). This thickness may typically be several hundred microns. Bonded to this substrate is capping layer 22, which may be silicon, glass, ceramic, metal, plastic or any suitable material that can form the fluid reservoir 20, reservoir inlet 40 and optional reservoir outlet 50. Unlike the print head of FIG. 3, the component alignment accuracy requirements associated with the print head of FIG. 4 are reduced since nozzle channels 30 are aligned with backside tunnels 80 during fabrication.

Figure 5:
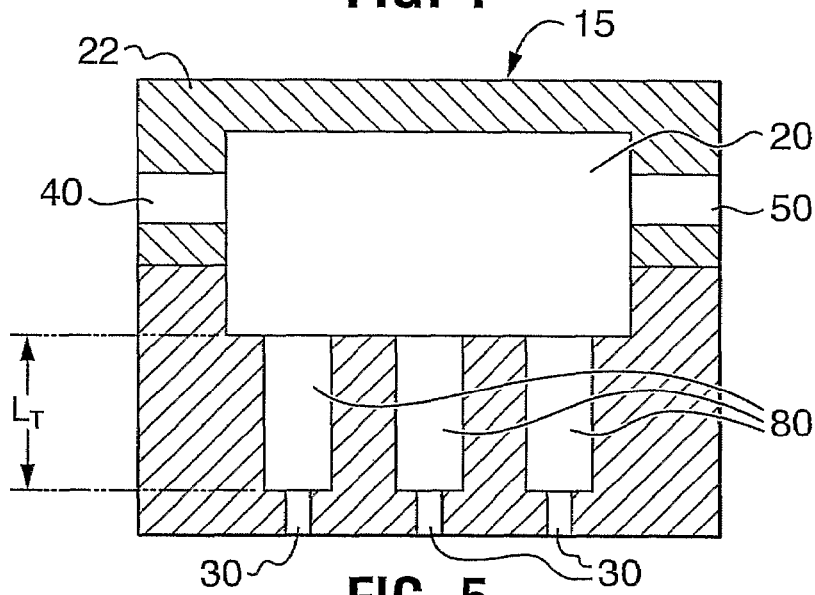
FIG. 5 is a cross-sectional view of a portion of an inkjet print head according to an embodiment of the invention in which backside tunnels, nozzle channels and a portion of a reservoir are combined in a monolithic component.

FIG. 5 shows a cross-sectional view of a portion of a print head 15 according to yet another embodiment of the present invention in which a portion of reservoir 20 is fabricated in the same substrate component that incorporates backside tunnels 80 and nozzle channels 30. The substrate component may be a silicon wafer, for example. Backside tunnels 80 need not be the full depth of the wafer above nozzle channels 30, but are equal or greater in length than the minimum length $L_T$ required to establish fully developed flow therein. In the FIG. 5 embodiment, manufacturing limitations may require multiple and/or different etching processes. For example, DRIE may be used to etch the backside tunnels 80 and nozzle channels 30, while a wet etch may be employed to define the larger area reservoir recess. The remaining portion of reservoir 20 may be micro-machined in capping layer 22 which may then be bonded to the substrate. It should be noted that etching to known depths or positions within a substrate may be accomplished by etching substrates that incorporate stop layers at the desired positions. Stop layers may include by example, various oxides that cannot be as readily etched as the rest of the substrate.

Figure 6:
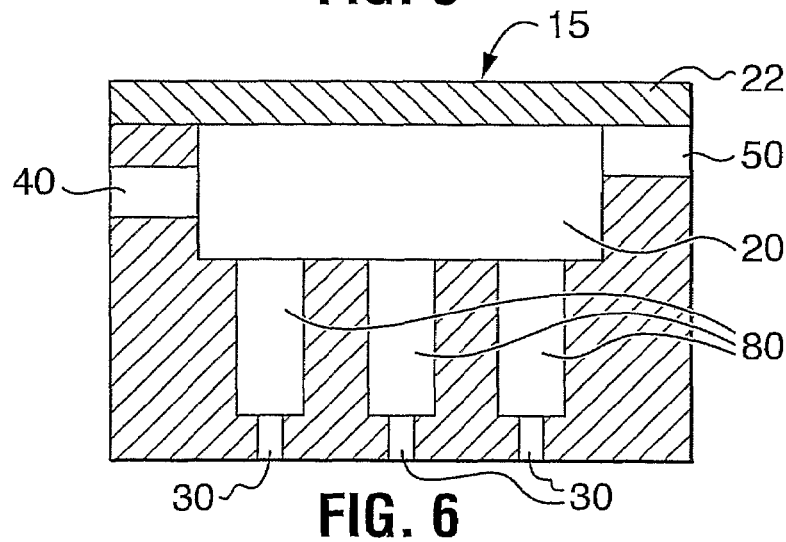
FIG. 6 is a cross-sectional view of a portion of an inkjet print head according to an embodiment of the invention in which a reservoir inlet and outlet are also produced in a monolithic component that incorporates backside tunnels, nozzle channels and a reservoir.

FIG. 6 shows a cross-sectional view of a portion of a print head 15 according to yet another embodiment of the invention in which reservoir inlet 40 and reservoir outlet 50 are formed in a monolithic component that also includes nozzle channels 30, backside tunnels 80 and reservoir 20. These features can be fabricated in the monolithic component in many ways, including providing surface channels that are enclosed by capping layer 22 bonded to the top of the monolithic component (exemplified by reservoir outlet 50), or wet etching low aspect ratio horizontal channels within the bulk of the monolithic component (exemplified by reservoir inlet 40).

Figure 7:
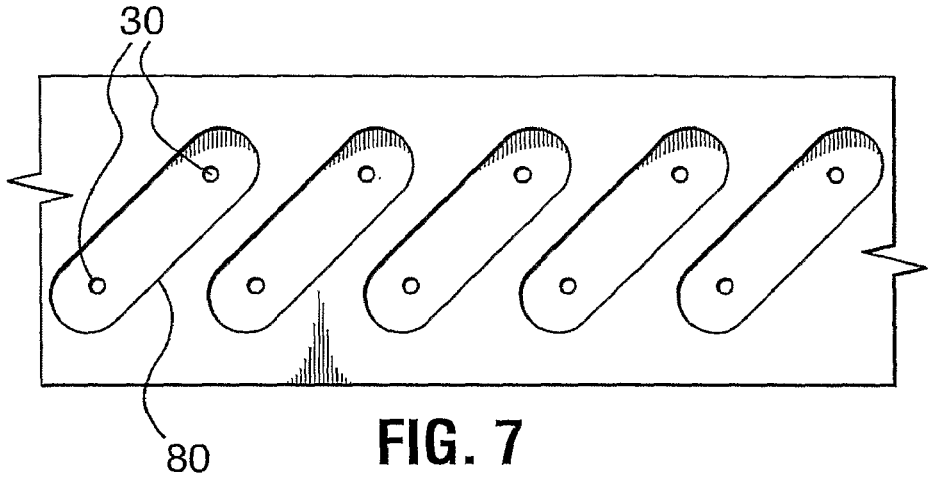
FIG. 7 is a partial top plan view of a portion of an inkjet print head according to an embodiment of the invention in which a backside tunnel provides substantially equal flow conditions to two nozzle channels.

FIG. 7 shows a top plan view of a portion of an inkjet print head according to another embodiment of the invention in which multiple nozzle channels 30 of the print head are arranged in a two dimensional array. In the FIG. 7 embodiment, there are two rows of equally spaced nozzle channels 30 that are offset from one another. Backside tunnels 80 are in the form of elongated slots and are arranged to connect multiple nozzle channels 30 such that each backside tunnel 80 corresponds to a pair of nozzle channels 30. In other embodiments, a single backside tunnel 80 may correspond to any suitable number of nozzle channels 30. The axial length into the substrate that each backside tunnel extends into is again sufficiently long to allow fully developed flow to be established therein. This axial length may be determined in a manner similar to that described above using the appropriate entrance length number equations that correspond to the shape of the elongated slots and the physical parameters of the fluid system. The FIG. 7 print head may be fabricated according to any of the construction methods described above.

Figure 8:
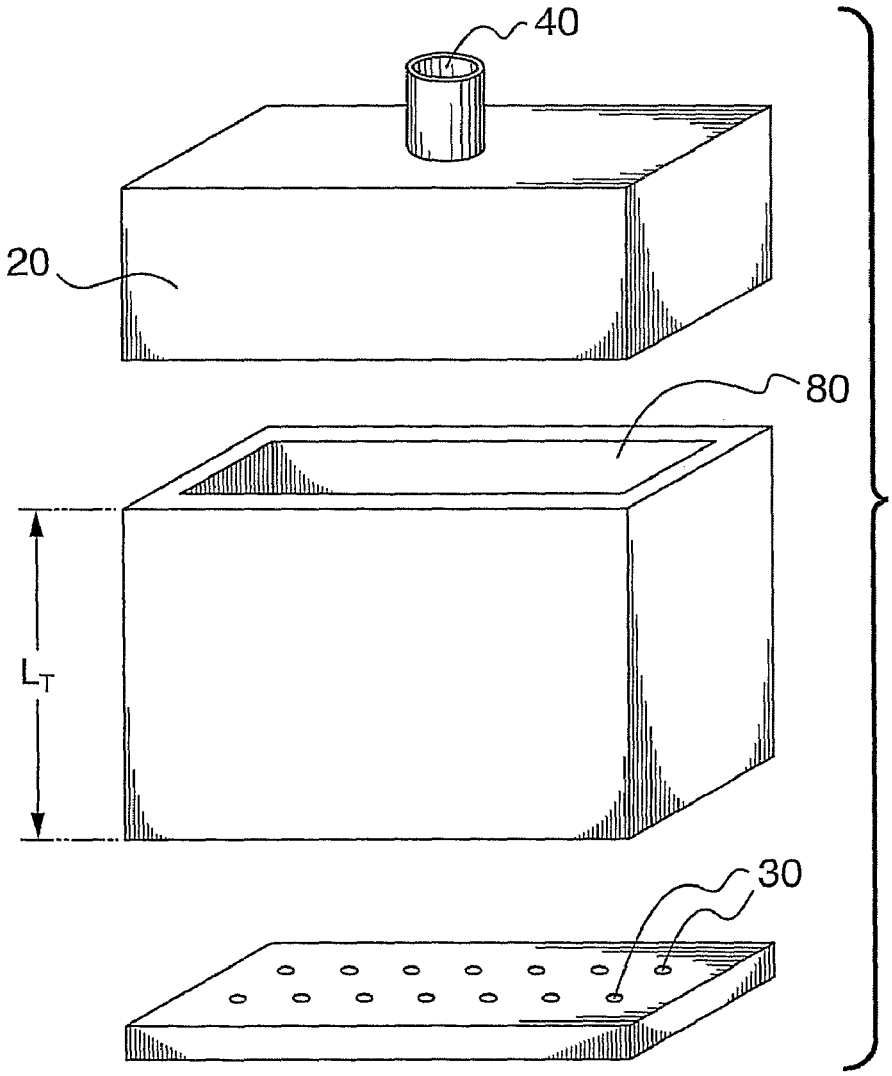
FIG. 8 is an exploded view of a portion of an inkjet print head according to an embodiment of the invention in which a single backside tunnel provides substantially equal flow conditions to all the nozzle channels in a nozzle channel array.

FIG. 8 shows an exploded view of an inkjet head according to yet another embodiment of the invention in which a single backside tunnel 80 is arranged as a conduit encompassing the entire plurality of nozzle channel openings. The axial length of the single backside tunnel 80 is such that fully developed flow occurs within this length.

Figure 9:
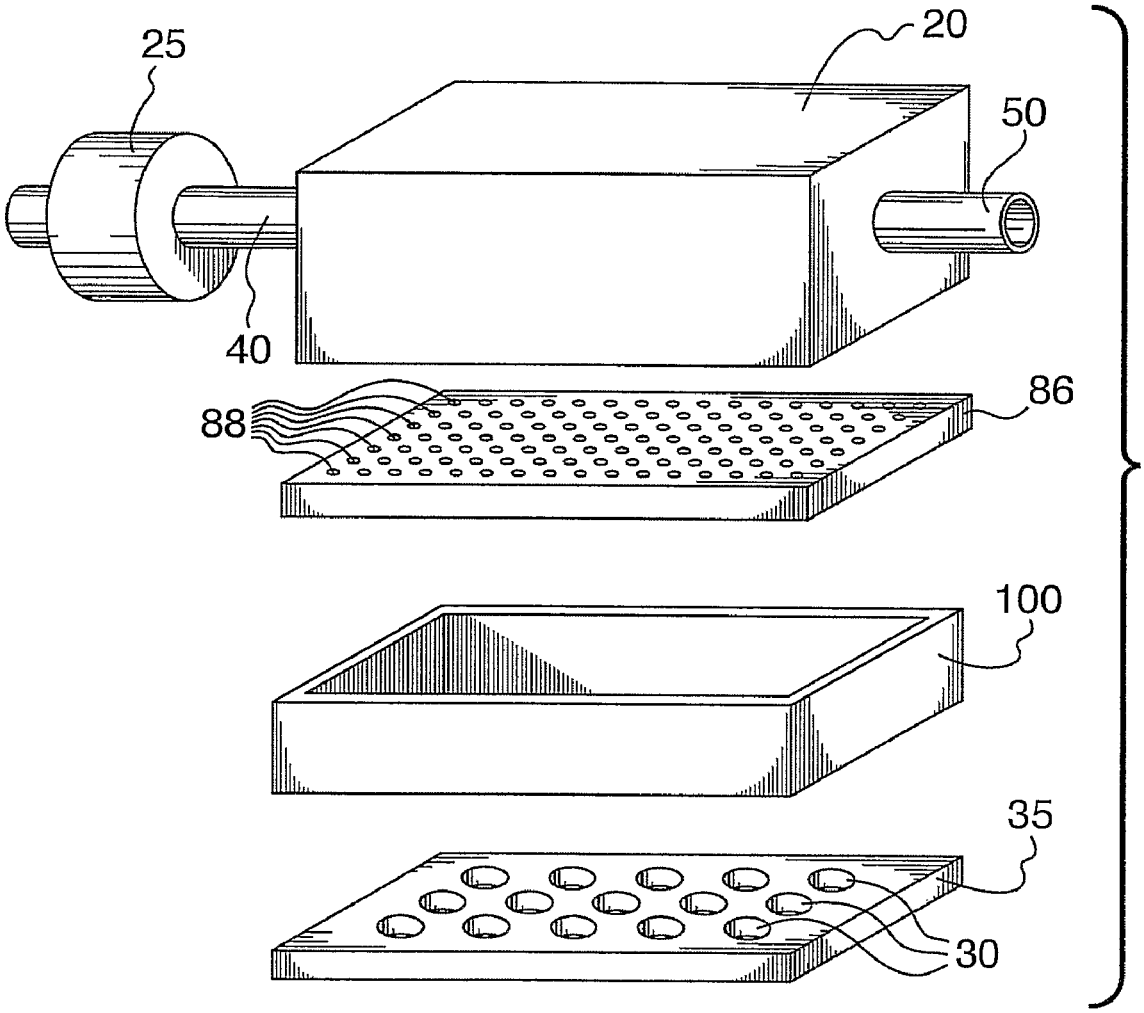
FIG. 9 is an exploded view of a portion of an inkjet print head according to an embodiment of the invention in which a flow conditioning plate is used to provide substantially equal flow conditions to an array of nozzle channels.

FIG. 9 is an exploded view of an inkjet print head according to another embodiment of the invention. In the FIG. 9 embodiment, fluid flows through optional particulate filter 25 and enters reservoir 20 of the print head via reservoir inlet 40. In the FIG. 9 embodiment, the flow conditioning means includes a flow conditioning plate 86. Flow conditioning plate 86 is perforated by a plurality of conduits referred to as flow conditioning bores 88. Preferably, the number of flow conditioning bores 88 significantly exceeds the number of nozzle channels 30 formed in nozzle plate 35. Flow conditioning bores 88 may be micro-machined into flow conditioning plate 86 which may be a separate component from nozzle plate 35 or accumulator 100. The axial length of flow conditioning bores 88 is determined by the requirement to establish fully developed flow within the regions of the print head corresponding to these bores. Optional fluid accumulator 100 allows for fluid connectivity between the outlet side of flow conditioning bores 88 and the inlets of nozzle channels 30. Each of the flow conditioning bores 88 are preferably smaller in cross-sectional diameter or size than the openings created by each of the nozzle channels 30. Although FIG. 9 shows an embodiment in which all of the components are separately fabricated and subsequently assembled, it may be beneficial to construct as many of the components in a monolithic structure as is feasible. Techniques similar to those discussed above may be used for this purpose.

Due to the relatively large number of flow conditioning bores 88, a lower flow velocity occurs in these bores. This reduced velocity in turn reduces the axial length necessary for fully developed flow to be established in flow conditioning bores 88. Flow conditioning bores 88 preferably have a small bore to axial length (or cross-sectional area to axial length) aspect ratio, thus allowing the bores to be readily formed by a micro-machining process such as etching.

The entrance length or minimum axial length for the development of fully developed flow in flow conditioning bores 88 may be determined by the physical parameters defining the Reynolds number, Re, of the fluid system. These parameters may include the fluid density, ρ; the average flow velocity in the bore, V; the diameter of the bore, D; and the fluid viscosity, μ. Specifically, for cylindrical flow conditioning bores:

$$Re=\rho VD/\mu.$$

The minimum flow conditioning bore length for fully developed laminar flow in a cylindrical bore is given by:

$$L_T=E_L D$$

where $L_T$ is the entrance length required to produce fully developed laminar flow, and; $E_L$ is the entrance length number derived from the relationship: $E_L=0.06$ Re.

The volume flow rate through flow conditioning plate 86 can be determined by the number $N_F$ of flow conditioning bores 88 that each have a cross sectional area $A_F$ (and associated diameter $D_F$) and the average fluid velocity $V_F$ through flow conditioning plate 86. Likewise, the volume flow rate through the nozzle channel plate 35 can be determined by the number $N_N$ of nozzle channels 30 that each have a cross sectional area $A_N$ (and associated diameter $D_N$) and the average fluid velocity $V_N$ through nozzle channel plate 35. Cross sectional area herein refers to the area of a conduit that is perpendicular to a flow traveling through the conduit. The two volume flow rates will equal each other and this relationship can be represented by:

$$A_F V_F N_F = A_N V_N N_N.$$

For cylindrical channels 30 and bores 88, the ratio of fluid velocities in the flow conditioning bores 88 and nozzle channels 30 is represented by:

$$V_F/V_N=(D_N/D_F)^2(N_N/N_F).$$

The ratio of the flow conditioning bore length and the nozzle channel length is then:

$$L_F/L_N=(V_F/V_N)(D_F/D_N)^2 \text{ or:}$$

$$L_F/L_N=N_N/N_F$$

The above equations define the relationship between the minimum axial lengths required to produce fully developed flow in flow conditioning bores 88 and nozzle channels 30 as a function of their respective total numbers. By way of example, a nozzle channel plate including nozzle channels each having a diameter, $D_N$=18 μm would require an entrance length of $L_N$=250 μm for fully developed flow to be established if the nozzle plate were to be used alone. If a corresponding flow conditioning plate has one hundred 10 μm diameter flow conditioning bores for every one nozzle channel (i.e. $N_F/N_N$=100, $D_F$=10 μm), each flow condition bore would only require an entrance length $L_F$=2.5 μm for fully developed flow to be established. The flow condition plate with flow conditioning bores that are 10 μm in diameter and 2.5 μm in length is readily etched, whereas a nozzle channel plate with 18 μm diameter channels that are 250 μm long would be difficult to etch in a uniform and timely manner. Obviously, the exemplary flow conditioning plate described above can be produced by etching flow conditioning bores deeper than the 2.5 μm length required to establish fully developed flow. This may be done to produce a flow conditioning plate with greater mechanical strength characteristics. Deeper bores would not affect the ability to establish fully developed flow. Further, it should be noted that a greater number of flow conditioning bores does not require greater micro-machining time since all the bores could be etched simultaneously. Advantageously, etching a flow conditioning plate with bores a mere 2.5 μm deep may provide substantial time-savings, regardless of their number.

The exemplary flow conditioning plates described above may act as flow conditioning means for nozzle channel plates that have been produced to suit particular manufacturing processes and mechanical strength requirements, but whose nozzle channels are of insufficient length to have fully developed flow established within the nozzle channel plates themselves. Non-uniform jet pointing across the nozzle channels is minimized even though the flow may not be fully developed within the nozzle channels themselves. Each of the nozzle channel inlets are exposed to substantially equal input flow conditions due to the presence of the flow conditioning plates. The memory of any variation in the fluid flow at the inlets of the flow conditioning plates are eliminated and non-uniform jet pointing effects are minimized.

The number of flow conditioning bores 88 may exceed the number of nozzle channels 30 by two or three orders of magnitude or more. This arrangement usually occurs because typically only a limited number of rows of nozzle channels 30 are fabricated per die, due to the need to incorporate electrical contacts to electrodes near nozzle channels 30. There are no such restrictions on the layout of flow conditioning bores 88 in flow conditioning plate 86, and hence their number and/or density can be greater than the number and/or density of nozzle channels 30.

When fluid accumulator 100 is employed, the flow conditioning bores 88 may be the same size and shape to ensure that the regions of the fluid within the flow conditioning bores 88 have substantially the same flow conditions. Fluid accumulator 100 accumulates all the regions of the fluid that pass through the flow conditioning bores 88 to produce substantially the same flow conditions at the nozzle channel plate 35. One or more of the flow conditioning bores 88 may also be of different sizes or shapes such that the fully developed flow established within the one or more flow conditioning bores has different flow conditions from the rest of the flow conditioning bores. These different flow conditions may be used to adjust the flow conditions in fluid accumulator 100 to produce substantially the same flow conditions at the nozzle channel plate.

Particulate clogging is a problem inherent to inkjet print heads, especially those with small diameter nozzle channels. Particulates circulating in the fluid can cause either a complete blockage or a partial blockage in a nozzle channel. This in turn causes the fluid jetted from that nozzle channel to be randomly steered from its intended trajectory. Blockage of nozzles or the inadvertent steering of jets is deleterious to high quality printing, and affects the reliability of the inkjet printing head, thus requiring more frequent maintenance or replacement of print heads. Fluid supply systems in inkjet printing devices often incorporate filters to minimize problems associated with particulates. These filters cannot be 100% effective as even the act of installing the filters themselves can produce particulates downstream of the filter that may lead to nozzle failure.

The diameter of flow condition bores 88 may be chosen in part to act as a particulate filter for particles of sufficient size to block or partially occlude a downstream nozzle channel 30. A practical range of flow conditioning bore sizes would thus be determined by the ability to establish fully developed flow, the ability to manufacture, mechanical strength requirements, and desired filtering characteristics. Flow conditioning plate 86 will occasionally catch particulates by having some of its own flow conditioning bores 88 blocked. Given that there are a large number of flow conditioning bores 88, and that the bulk of the filtration is performed upstream by the primary filters, the frequency of blocking a significant number of flow conditioning bores 88 is relatively low. Therefore, the flow conditioning aspects of flow conditioning plate 86 are not adversely affected by this filtering action.

Another embodiment of the invention incorporates flow conditioning bores 88 having larger cross sectional areas than the cross sectional areas of nozzle channels 30. The number of flow conditioning bores 88 again preferably exceeds the number of nozzle channels 30 and the depth of the bores would be chosen to establish fully developed flow. However, in such an arrangement, secondary filtration by flow conditioning plate 86 is limited to particles larger than the opening provided by flow conditioning bores 88.

In another embodiment of the invention, flow conditioning plate 86 is located immediately adjacent to nozzle plate 35 and there is no fluid accumulator 100 therebetween. Again, fully developed flow is established in the regions of the fluid that travel in flow conditioning bores 88. In this embodiment, the fluid regions are proximate to inlets of the nozzle channels 30. Where flow conditioning bores 88 have a cross sectional area that is comparable or larger than the cross sectional area of nozzle channels 30, care should be taken in the alignment of flow condition plate 86 to nozzle channel plate 35. In such an arrangement, the degree of overlap and relative position of overlap between each of the flow conditioning bores 88 and each of the nozzle channels 30 is preferably substantially similar as between nozzle channels 30 in order to ensure consistent jetting across all the nozzle channels 30.

A preferred embodiment of the invention incorporates many flow conditioning bores 88, each with a cross sectional area much smaller than the cross sectional area of nozzle channels 30. In such an embodiment, the number of flow conditioning bores 88 significantly exceeds the number of nozzle channels 30, such that the rate of fluid flow into each of the inlets of nozzle channels 30 is substantially similar, regardless of any significant misalignment of flow conditioning plate 86 to nozzle channel plate 35. When a flow conditioning plate 86 is positioned immediately adjacent to the nozzle channel plate 35, the flow conditioning bores 88 are preferably of the same size and shape to ensure that the regions of the fluid within the flow conditioning bores have substantially similar flow conditions. Since these regions of fluid are proximate to the nozzle channel inlets, the flow conditions at the inlets will also be substantially similar.

The examples discussed above for the determination of the entrance length in which fully developed flow is established are representative of a situation describing a flow that is entirely viscous in nature. In these cases, the length needed for fully developed flow is entirely dependent on the internal frictional forces within the fluid and between the wall and the fluid. These forces may be modified by changing the surface roughness of the channel walls, by using large molecule weight fluids (or components of fluids) or by changing temperature, density, velocity or viscosity of the fluid at various points in its flow. In so doing, the entrance length will vary so that the point at which fully developed flow occurs differs depending on these parameters.

Examples of flow conditioning means comprising conduits of unchanging cross-section were disclosed. Other flow conditioning means of the present invention that use tapered conduits of varying cross-section (either converging or diverging) may have different entrance lengths at which fully developed flow will occur. In addition, other external forces can be added such as electrical or magnetic forces to affect the flow of polarizable, charged or magnetic fluids. Any of these factors may affect the functional relationship between the entrance length and the Reynold's number, and may be used in defining a flow conditioning means.

It may be advantageous to construct nozzle channel arrays such that the degree of jet pointing stability across an array of nozzle channels is not substantially equal across all nozzle channels of that array. In one such embodiment, a linear array comprising a row of nozzle channels may be divided into 3 parts: a central subgroup of nozzle channels, and two end subgroups of nozzle channels. A first flow conditioning means is applied to a first region or regions of a fluid in the print head to establish a first set of substantially equal flow conditions at the inlets of the central subgroup of nozzle channels. The first flow conditioning means establishes fully developed flow conditions within the first region or regions of a fluid to create the first set of substantially equal flow conditions at the inlets of the central subgroup of nozzle channels.

A second conditioning means may be additionally employed to establish a second set of substantially equal flow conditions at the inlets of the two end subgroups of nozzle channels. The second conditioning means establishes a flow within a second region or regions of the fluid in the print head to create the second set of substantially equal flow conditions. The flow in the second region or regions may or may not be fully developed. Additionally, the first set of substantially equal flow conditions may not be the same as the second set of substantially equal flow conditions. This arrangement may result in varying degrees of jet pointing stability between the central and two end subgroups of nozzles in the array. Multiple nozzle arrays, each comprising this embodiment may be 'stitched' together end-to-end to create an ink jet print head. The varying degree of jet point stability created by the end sections of each array can be used to reduce observable non-uniformity of printed density across the print stitch boundary printed by the multiple arrays.

Alternatively, the second conditioning means may establish flow conditions that are unequal across at least a part of the inlets of the nozzle channels that make up the end subgroups of the array. This results in a greater degree of variability in jet point stability between the central and end sub groups of nozzle channels in each array. Again, this variability in the degree of jet pointing ability can help to reduce observable non uniformity of printed density across the print stitch boundaries created by multiple arrays stitched together or by a single array that is translated to print across the media.

The multiple fluid jets emitted by the continuous ink jet print heads of the embodiments of the present invention may be stimulated to produce corresponding streams of droplets by any suitable droplet generation means known in the art. Such droplet generation means may include, but are not limited to, electrohydrodynamic and piezoelectric stimulation electrodes. The corresponding streams of droplets may be separated into printing droplets and non-printing droplets by any suitable droplet separation means including electrostatic droplet separation means that include charging electrodes and deflection plates.

There have thus been outlined the important features of the invention in order that it may be better understood, and in order that the present contribution to the art may be better appreciated. Those skilled in the art will appreciate that the conception on which this disclosure is based may readily be utilized as a basis for the design of other methods and apparatus for carrying out the several purposes of the invention. It is most important, therefore, that this disclosure be regarded as including such equivalent methods and apparatus as do not depart from the spirit and scope of the invention.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A method for jetting at least one continuous stream of fluid from at least one nozzle channel of a multi-channel print head, the method comprising:

establishing substantially fully developed flow in at least one first region of a fluid in the print-head;

jetting the fluid in at least a portion of the at least one first region from the at least one nozzle channel; and wherein fully developed flow comprises a bounded flow in a conduit having the characteristics of an unchanging velocity profile within the conduit, where the wall shear is at least approximately constant and the pressure drops at least approximately linearly with distance along the axial length of the conduit.

2. The method of claim 1, wherein the at least one nozzle channel comprises a plurality of nozzle channels, each nozzle channel comprising an inlet and wherein the method comprises establishing substantially equal flow conditions at each of the inlets.

3. The method of claim 1, wherein the at least one nozzle channel comprises an inlet and the at least one first region is proximate to the inlet.

4. The method of claim 1, comprising establishing substantially fully developed flow in a plurality of first regions of the fluid in the print head wherein the plurality of first regions have substantially equal flow conditions.

5. The method of claim 1, wherein the substantially fully developed flow is established by a first flow conditioning means.

6. The method of claim 5, wherein the first flow conditioning means establishes substantially fully developed laminar flow in the at least one first region.

7. The method of claim 5, wherein the first flow conditioning means comprises at least one conduit, an axial length of the at least one conduit being equal to or greater than an entrance length associated with the at least one conduit, and wherein the method further comprises establishing substantially fully developed flow within the at least one conduit.

8. The method of claim 7, wherein the axial length of the at least one conduit is sized to establish substantially fully developed laminar flow within the at least one conduit.

9. The method of claim 7, comprising establishing a first volume flow rate of the fluid through the at least one conduit and a second volume flow rate of the fluid through the at least one nozzle channel, wherein the first and second volume flow rates are equal.

10. The method of claim 5, comprising:

establishing a second flow in at least one second region of the fluid in the print head; and jetting the fluid in at least a portion of the at least one second region from at least one additional nozzle channel.

11. The method of claim 10, wherein the at least one additional nozzle channel comprises a plurality of additional nozzle channels, each additional nozzle channel comprising an additional inlet and wherein the method comprises establishing substantially equal flow conditions at each of the additional inlets.

12. The method of claim 10, wherein the at least one additional nozzle channel comprises an inlet and the at least one second region is proximate to the inlet.

13. The method of claim 10, comprising establishing second flows in a plurality of second regions of the fluid in the print head, wherein the plurality of second regions have substantially equal flow conditions.

14. The method of claim 10, wherein the second flow comprises substantially frilly developed flow.

15. The method of claim 14, wherein the second flow is established to be substantially fully developed by a second conditioning means.

16. The method of claim 14, wherein the second flow comprises substantially fully developed laminar flow.

17. A multi-channel print head for jetting at least one continuous stream of fluid, the print head comprising:

at least one first flow conditioning means operable for establishing substantially fully developed flow in at least one first region of a fluid in the print head; and at least one nozzle channel in fluid communication with the at least one first region, the at least one nozzle channel operable for jetting the at least one continuous stream from at least a portion of the at least one first region;

comprising a fluid accumulator, wherein the fluid accumulator is positioned between the at least one first flow conditioning means and the at least one nozzle channel.

18. The print bead of claim 17, wherein the at least one nozzle channel comprises a plurality of nozzle channels, each nozzle channel comprising an inlet, and the at least one first flow conditioning means is operable for establishing substantially equal flow conditions at each of the inlets.

19. The print head of claim 17, wherein the at least one nozzle channel comprises an inlet and the first at least one first region is proximate to the inlet.

20. The print head of claim 17, wherein the at least one first region comprises a plurality of first regions and the at least one first flow conditioning means is operable for establishing substantially equal flow conditions in the plurality of first regions.

21. The print head of claim 17, wherein the at least one first flow conditioning means is operable for establishing substantially fully developed laminar flow in the at least one first region.

22. A multi-channel print head for jetting at least one continuous stream of fluid, the print head comprising:

at least one first flow conditioning means operable for establishing substantially filly developed flow in at least one first region of a fluid in the print head; and at least one nozzle channel in fluid communication with the at least one first region, the at least one nozzle channel operable for jetting the at least one continuous stream from at least a portion of the at least one first region;

wherein the at least one first flow conditioning means comprises a least one backside tunnel, the at least one backside tunnel being operable for establishing the substantially fully developed flow in the at least one first region.

23. The print head of claim 22, wherein the at least one backside tunnel comprises an axial length equal to or greater than an entrance length associated with the at least one backside tunnel.

24. The print head of claim 23, wherein the at least one backside tunnel is in direct fluid communication with the at least one nozzle channel.

25. The print head of claim 22, wherein at least one of: the at least one nozzle channel and the at least one backside tunnel is fabricated by micro-machining.

26. The print head of claim 25, wherein the at least one backside tunnel and the at least one nozzle channel are fabricated in a monolithic component.

27. A multi-channel print head for jetting at least one continuous stream of fluid, the print head comprising:

at least one first flow conditioning means operable for establishing substantially fully developed flow in at least one first region of a fluid in the print head; and at least one nozzle channel in fluid communication with the at least one first region, the at least one nozzle channel operable for jetting the at least one continuous stream from at least a portion of the at least one first region;

wherein the at least one first flow conditioning means comprises a flow conditioning plate, the flow conditioning plate comprising at least one flow conditioning bore operable for establishing the substantially fully developed flow in the at least one first region.

28. The print head of claim 27, wherein the at least one flow conditioning bore comprises an axial length equal to or greater than an entrance length associated with the at least one flow conditioning bore.

29. The print head of claim 28, wherein the at least one flow conditioning bore comprises a plurality of flow conditioning bores and a number of the flow conditioning bores is greater than a number of the at least one nozzle channel.

30. The print head of claim 27, wherein the at least one flow conditioning bore comprises a first cross-sectional area, the at least one nozzle channel comprises a second cross-sectional area and the first cross-sectional area is smaller than the second cross-sectional area.

31. The print head of claim 30, wherein the flow conditioning plate is a filter means.

32. The print head of claim 27, comprising a fluid accumulator positioned between the flow conditioning plate and the at least one nozzle channel.

33. The print head of claim 27, wherein the flow conditioning plate is fabricated by micro-machining.

34. The print head of claim 27, wherein the at least one nozzle channel is the flow conditioning means.

35. The print head of claim 34, wherein the at least one nozzle channel comprises an axial length equal to or greater than an entrance length associated with the at least one nozzle channel.

36. The print head of claim 27, further comprising:

at least one second conditioning means operable for establishing a second flow in at least one second region of the fluid in the print head; and at least one additional nozzle channel of the multi-channel print head in fluid communication with the at least one second region, the at least one additional nozzle channel operable for jetting at least one additional continuous stream of the fluid from at least a portion of the at least one second region.

37. The print head of claim 36, wherein the at least one additional nozzle channel comprises a plurality of additional nozzle channels, each additional nozzle channel comprising an additional inlet, and the at least one second conditioning means is operable for establishing substantially equal flow conditions at each of the additional inlets.

38. The print head of claim 36, wherein the at least one additional nozzle channel comprises an additional inlet and the at least a second region is proximate to the additional inlet.

39. The print head of claim 36, wherein the at least one second region comprises a plurality of second regions and the at least one second conditioning means is operable for establishing substantially equal flow conditions in the plurality of second regions.

40. The print head of claim 39, wherein the flow conditions in the at least one first region are different than the flow conditions in the at least one second region.

41. The print head of claim 36, wherein the second flow comprises substantially hilly developed flow.

42. A multi-channel print head for jetting at least one continuous stream of fluid, the print head comprising:

at least one first flow conditioning means operable for establishing substantially fully developed flow in at least one first region of a fluid in the print head; and at least one nozzle channel in fluid communication with the at least one first region, the at least one nozzle channel operable for jetting the at least one continuous stream from at least a portion of the at least one first region;

at least one second conditioning means operable for establishing a second flow in at least one second region of the fluid in the print head; and at least one additional nozzle channel of the multi-channel print head in fluid communication with the at least one second region, the at least one additional nozzle channel operable for jetting at least one additional continuous stream of the fluid from at least a portion of the at least one second region wherein the second flow comprises substantially fully developed flow;

wherein at least one of the first flow conditioning means and the second conditioning means comprises at least one of: a back side tunnel and a flow conditioning plate.

* * * * *

UNITED STATES PATENT AND TRADEMARK OFFICE

CERTIFICATE OF CORRECTION

PATENT NO. : 7,607,766 B2
APPLICATION NO. : 11/568229
DATED : October 27, 2009
INVENTOR(S) : Thomas W. Steiner It is certified that error appears in the above-identified patent and that said Letters Patent is hereby corrected as shown below:

| Issued Patent Column | Issued Patent Line | Description of Error |
|---|---|---|
| 17 | 41 (Approx.) | In Claim 14, delete "frilly" and insert -- fully --. |
| 17 | 60 | In Claim 18, delete "bead" and insert -- head --. |
| 18 | 13 | In Claim 22, delete "filly" and insert -- fully --. |
| 20 | 8 | In Claim 41, delete "hilly" and insert -- fully --. |

Signed and Sealed this

Twenty-eighth Day of September, 2010

David J. Kappos

David J. Kappos
*Director of the United States Patent and Trademark Office*